US012789069B2

(12) United States Patent
Xanthopoulos

(10) Patent No.: US 12,789,069 B2
(45) Date of Patent: Nov. 10, 2026

(54) MARTIAL ARTS TRAINING DUMMY

(71) Applicant: Dimitrios Xanthopoulos, Athens (GR)

(72) Inventor: Dimitrios Xanthopoulos, Athens (GR)

( * ) Notice: Subject to any disclaimer, the term of this patent is extended or adjusted under 35 U.S.C. 154(b) by 37 days.

(21) Appl. No.: 18/997,246

(22) PCT Filed: Jul. 20, 2023

(86) PCT No.: PCT/GR2023/000032
§ 371 (c)(1),
(2) Date: Jan. 21, 2025

(87) PCT Pub. No.: WO2024/018240
PCT Pub. Date: Jan. 25, 2024

(65) Prior Publication Data

US 2026/0027437 A1 Jan. 29, 2026

(30) Foreign Application Priority Data

Jul. 21, 2022 (GR) ..... 20220100587

(51) Int. Cl.
*A63B 69/20* (2006.01)

(52) U.S. Cl.
CPC ..... *A63B 69/215* (2022.08); *A63B 2244/10* (2013.01)

(58) Field of Classification Search
CPC ..... A63B 69/215; A63B 2244/10; A63B 2244/108; A63B 69/34; A63B 2209/00; A63B 2225/09; A63B 23/047
See application file for complete search history.

(56) References Cited

U.S. PATENT DOCUMENTS 3,250,533 A * 5/1966 Nicholson ..... A63B 69/224 40/419
4,088,315 A * 5/1978 Schemmel ..... G01G 19/52 482/84
5,256,069 A * 10/1993 Snowden, Jr. ..... A63B 69/34 434/247
5,700,230 A * 12/1997 Cardona ..... A63B 69/34 482/90
8,777,818 B1 * 7/2014 Tate, Jr. ..... A63B 69/215 482/83
2008/0076636 A1 * 3/2008 Smith ..... A63B 69/28 482/1
2009/0098955 A1 * 4/2009 Crook, II ..... A63B 69/0002 473/422
2011/0281695 A1 * 11/2011 Machado ..... A63B 69/215 482/83
2012/0214648 A1 * 8/2012 Schlicher ..... A63B 69/224 482/87
2013/0137554 A1 * 5/2013 Knight ..... A63B 69/34 482/85
2014/0155228 A1 * 6/2014 Salerno ..... A63B 71/023 482/84
2014/0335493 A1 * 11/2014 Iocca ..... A63B 69/34 434/256

* cited by examiner

*Primary Examiner* — Andrew S Lo

(57) ABSTRACT

The invention relates to a training dummy for martial arts and combat sports. The dummy consists of parts that simulate the various parts of the human body and which are made of metal and covered with a soft material (21), such as polyurethane. The different parts of the dummy have fixed and variable inclinations so that it assumes natural postures and allows the correct training of the athlete.

3 Claims, 4 Drawing Sheets

MARTIAL ARTS TRAINING DUMMY

THE FIELD OF ART

The invention relates to the technical field of human needs and more specifically to the field of health, protection and entertainment. In particular, it relates to sports activities and even more specifically to training equipment for exercise. It specifically relates to training devices or devices for special sports. More specifically it relates to a martial arts and combat sports training dummy.

BACKGROUND OF THE INVENTION

The martial arts training dummy disclosed in the present invention has not been disclosed in its specific form in the prior art.

So far, martial arts and boxing athletes have a range of training tools with which they can train and practice their strikes. Thus, known so far are among others the training bag, the training targets, the wooden wing chun doll. All of the above show disadvantages, either because they have significant shortcomings, such as the training bag that does not have ends and therefore deprives the athlete of the possibility to develop his strikes, through closed defenses, or because they have requirements, such as the training targets that require an experienced fellow athlete—teacher for guidance. Furthermore, the wooden dummy places restrictions on specific and generally very limited movements that the practitioner can try, while also requiring attention to the intensity of the blows to avoid injuries.

In the past, metal dummies, such as that of application WO90/12622 or U.S. Pat. No. 5,256,069, have been disclosed, which consist of a metal frame and a bracket on the wall. Similarly, WO2013/084012, by the same applicant, was presented, which related to a dummy for practicing martial arts and combat sports, which was an advanced and improved version of the dummies known at the time.

It is thus an object of the present invention to advantageously address the aforementioned disadvantages and shortcomings of the prior art by proposing a martial arts training dummy.

A further object of the invention is to provide a martial arts training dummy, which has notches, both in the hands and in the legs, which allow changing the angle formed by them, presenting different postures and inclinations and increasing the naturalness of the positions.

It is a further object of the invention to provide a training dummy, having an adjustment silent block in combination with clamps with a collar and screws, for changing the joint angles, both at the upper and lower ends of the dummy.

It is still another object of the invention to provide a training dummy having clamps with blockages and silent blocks for adjusting, varying and stabilizing the dummy's upper and lower limb joints.

In addition, the martial arts training dummy of the present invention has blade-shaped ends to provide greater swing when striking, in order to create movement that gives even greater naturalness.

It is also an object of the present invention to provide a martial arts and combat sports training dummy that has silent blocks at the wrists, allowing the practitioner to train in disarming holds, since it has the necessary elasticity. Furthermore, when extending, the hand follows the straight line of the jaw, while when it retracts it can come very close to the face and torso of the dummy, giving even greater naturalness.

These and other objects, features and advantages of the invention will become apparent in the following detailed description.

BRIEF DESCRIPTION OF THE DRAWINGS

The invention will become apparent to those skilled in the art by reference to the accompanying drawings in which it is illustrated in an illustrative non-limiting manner.

DETAILED DESCRIPTION OF PREFERRED EMBODIMENT

Referring now to the accompanying drawings, we will describe exemplary embodiments of the martial arts and martial arts training dummy of the invention, so as to make apparent both its advantages and its methods of construction, assembly and operation.

Figure 1:
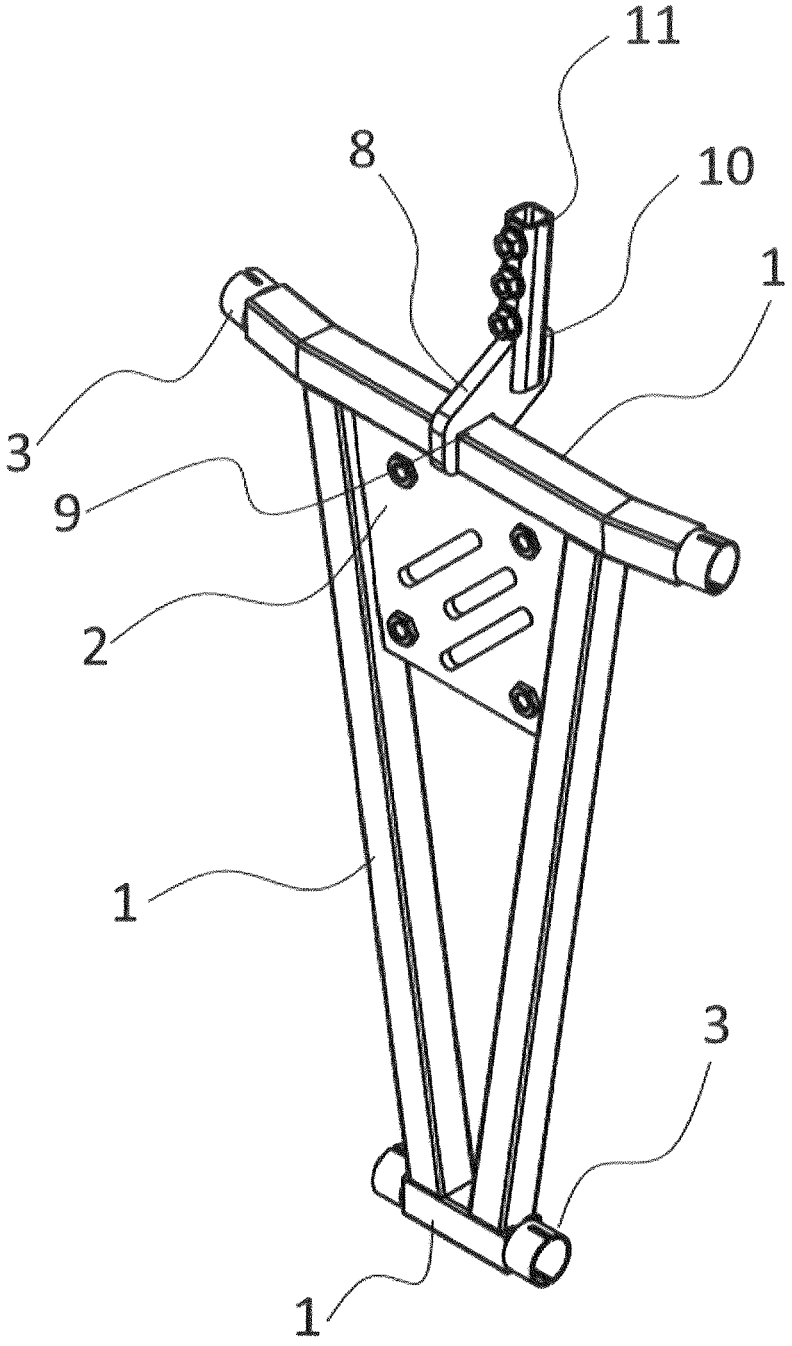
FIG. 1 shows the torso of the dummy of the invention.
Figure 3:
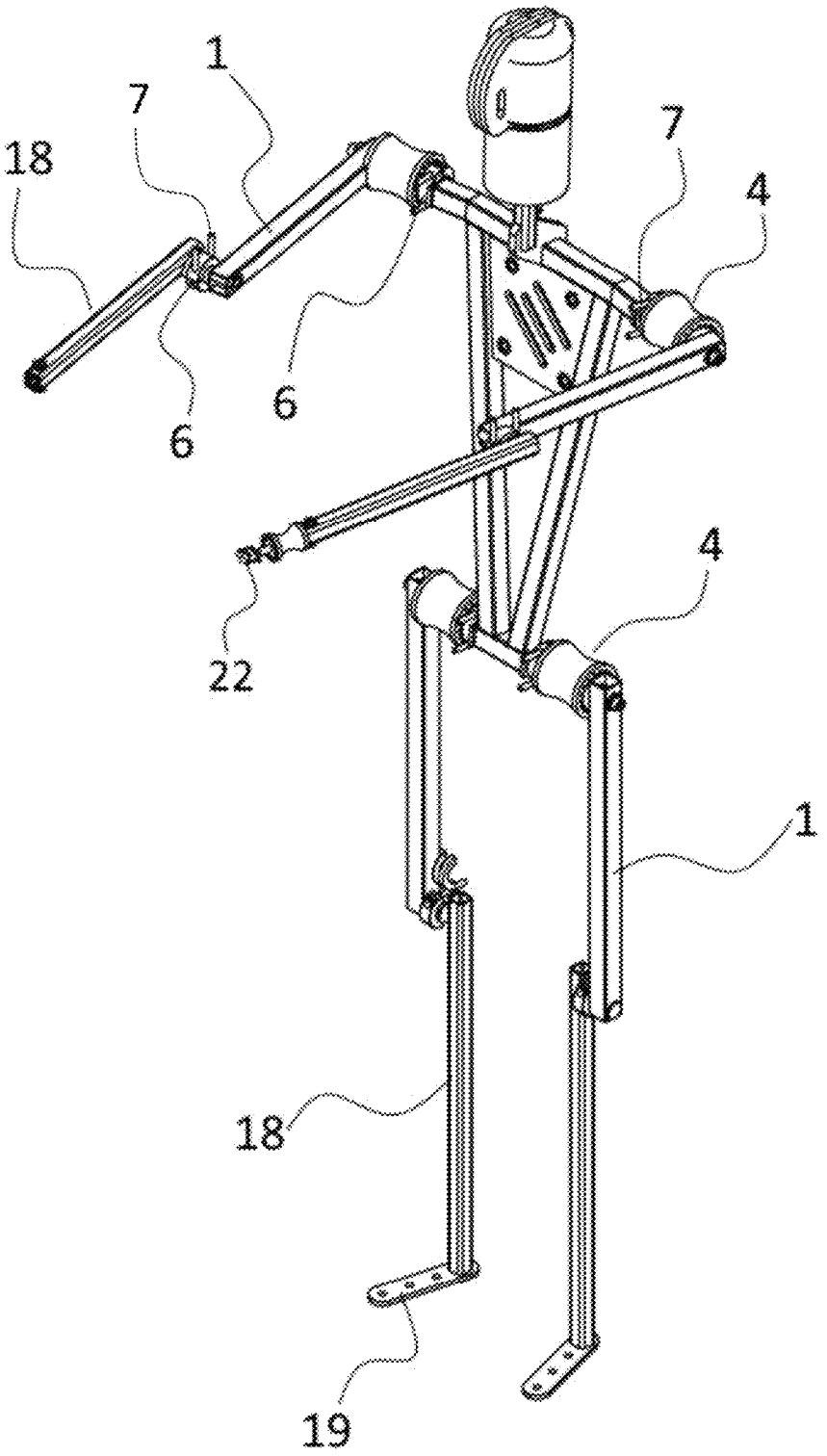
FIG. 3 shows the structural elements with the torso, head and limbs of the dummy.

The dummy consists of hollow beams (1), FIG. 1, welded around a flat plate (2). At least four hollow beams (1) are welded around the flat plate (2), but the upper hollow beam may be divided into four sections. Clamp tubes (3) are welded to the ends of the hollow beams (1) which form the torso of the dummy. Both the upper and lower ends of the dummy are attached to these clamp tubes (3). Corresponding clamp tubes (3) are present in the hollow beams (1) of each end. Between the clamp tubes (3) of the torso and the ends is inserted a device consisting of a silent block (4) with a string (5) that enters the clamp tubes (3). Locking in any position and therefore changing the angle of each end is done by using a clamp with a collar (6), FIG. 3. The clamp with the collar (6) secures and tightens the string (5) of the silent block (4), using screws (7), in the position we choose, preventing any inadvertent rotation.

Figure 2:
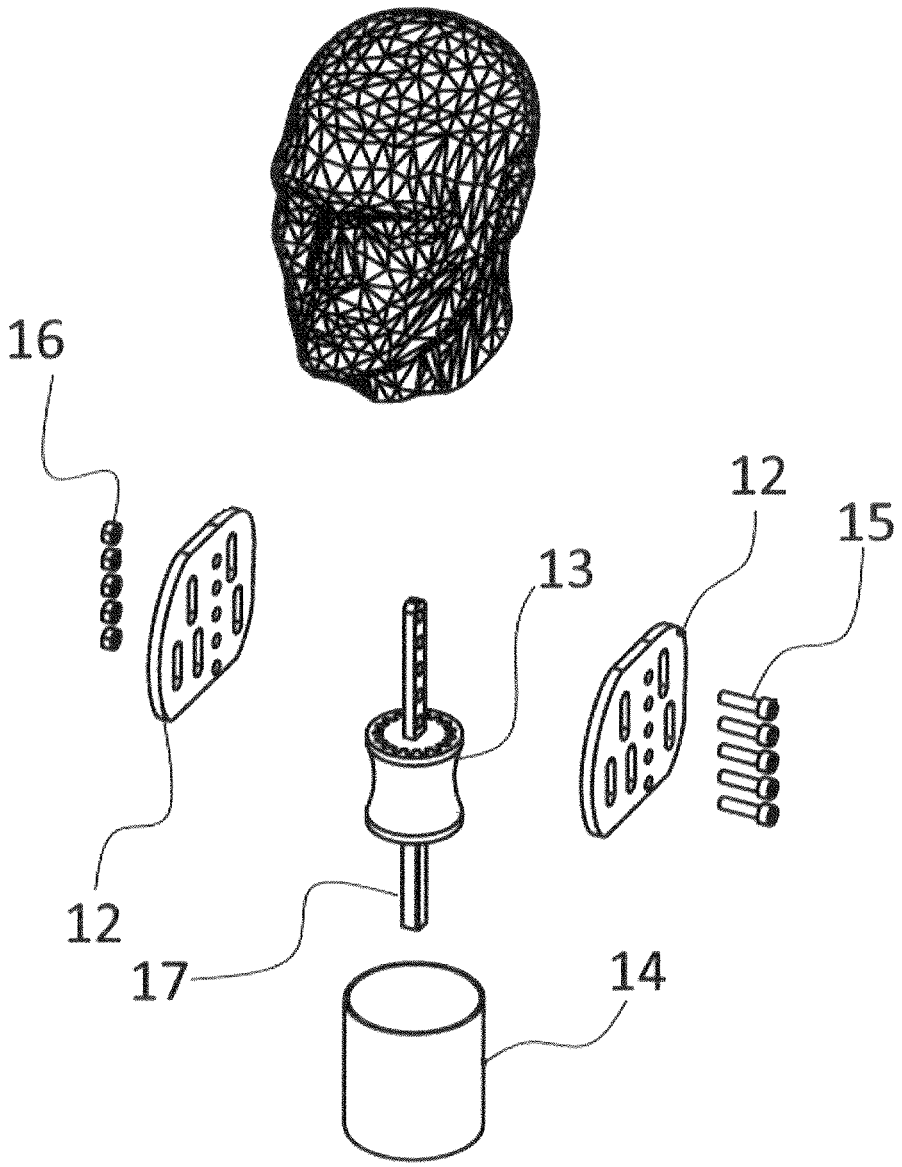
FIG. 2 shows the dummy's head.

At the top of the upper hollow beam (1) a vertical connection link (8) is placed, for the application of the head of the dummy. The vertical connection link (8) has two notches (9), (10), one on its lower side and the other on its upper side. The first of these applies to the upper hollow beam (1), while a vertical hollow beam (11) is applied to the second notch (10), which is the support of the dummy's head. The head of the dummy is formed by two parallel metal plates (12), FIG. 2, screwed on either side to a silent block (13), which is inserted into a polyurethane isolation tube (14), which is removable. Likewise around the parallel metal plates (12) filling with polyurethane is done to create the appropriate shape. The parallel plates (12) are screwed together using screws (15) and nuts (16). The silent block (13) has a string (17) with which it is fixed to the vertical beam (11).

Each hollow beam (1) corresponding to the upper arm is connected to a blade (18) simulating the forearm using a clamp with a collar (6) and screws (7). The same is the case with the hollow beams (1) and blades (18) corresponding to the femur and tibia of the dummy. The blade (18) of the tibia terminates in a flattened blade (19), which simulates the metatarsus, i.e. the foot from the ankle downwards. The flattened blade (19) may be a continuation of the tibial blade (18) or a separate part, joined or welded to it. For example, the hollow beams (1), the blades (18) as well as the flattened blade (19) are made of steel, without this being restrictive for the use of other materials. Accordingly, the blade (18), which simulates the forearm, ends in a silent block (4) with a torsion spring (22) at its end, to simulate the movements of the wrist.

Figure 4:
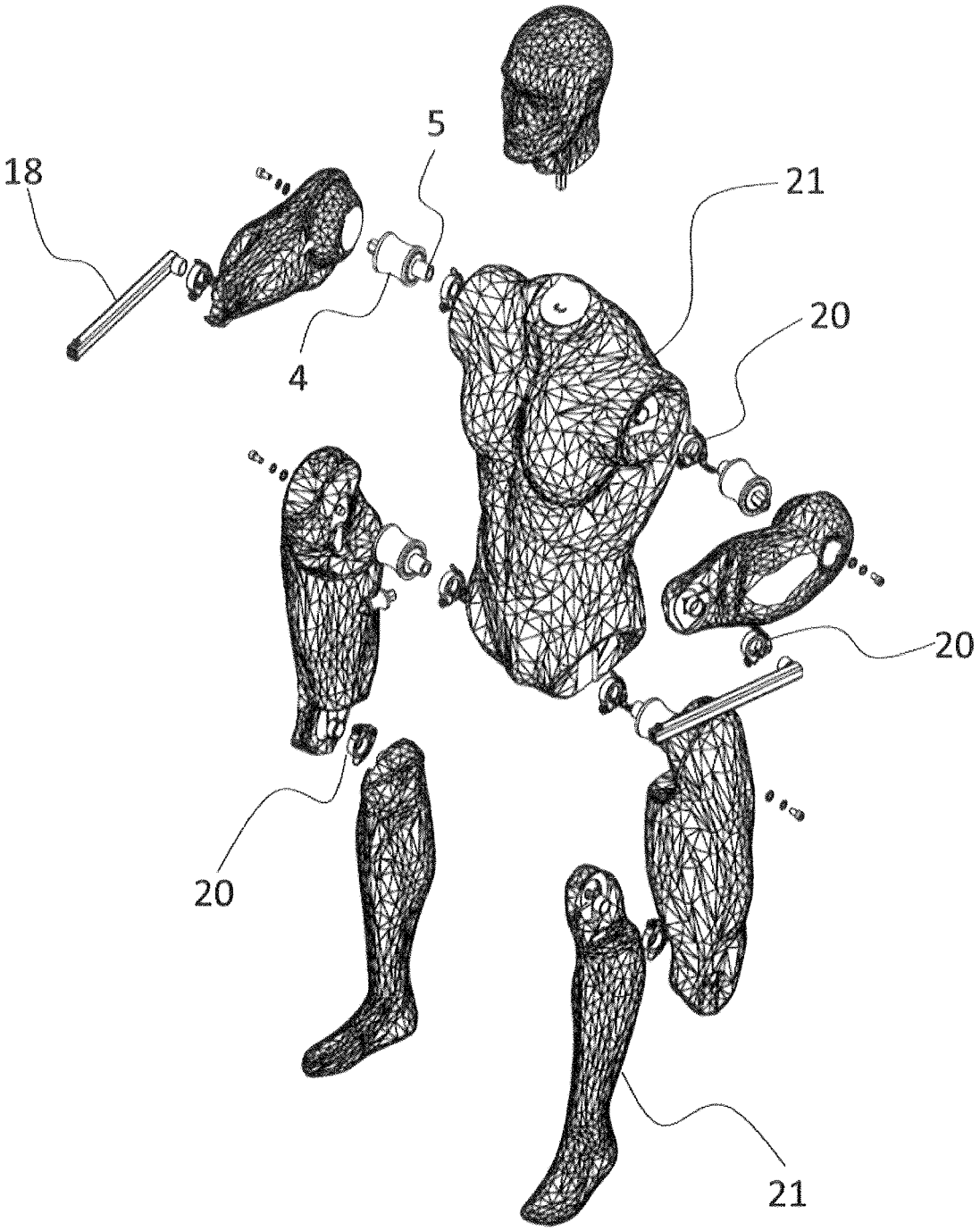
FIG. 4 shows an alternative embodiment of the invention, in terms of how to change the angles of the ends of the dummy.

Alternatively, the collar clamp (6) can be replaced by a locking clamp (20), FIG. 4. This clamp (20) is clamped around the string (5) securing the ends in the desired position. All metal parts are preferably covered by soft materials (21), such as polyurethane.

It should be noted at this point that the description of the invention was made with reference to illustrative examples, to which it is not limited. Therefore, any change or modification in terms of shape, dimensions, morphology, materials used and construction and assembly components, as long as they do not constitute a new inventive step and do not contribute to the technical development of what is already known, are considered included in the aims and objectives of the present invention.

The invention claimed is:

1. A martial arts training dummy, consisting of a flat plate and hollow beams welded around it, simulating the human torso, clamp tubes being placed at the ends of the hollow beams for connecting, through links, to other beams simulating the upper humerus and femur, blades, simulating the forearm and tibia and a head supported by a vertical connecting link on a vertical hollow beam, wherein between the clamp tubes and the hollow beams ends there is a silent block with a string and a clamp with a collar tightened with screws, while between the beams and the blades the connection is similarly made with a clamp with a collar which is tightened with screws.

2. The martial arts training dummy according to claim 1, wherein between the clamp tubes and the hollow beams of the ends there is placed a silent block with a string and a locking clamp, while between the hollow beams and the blades connection is similarly carried out with a locking clamp.

3. The martial arts training dummy according to claim 1, wherein the head consists of two parallel metal plates, screwed on either side to a silent block with a string, which is inserted into a polyurethane isolation tube and where the string is fixed to the vertical beam.

* * * * *